United States Patent [19]

Nehrig et al.

[11] 3,941,352

[45] Mar. 2, 1976

[54] BUMPER SCREW JACK

[75] Inventors: R. Harlan Nehrig, Stevensville; Nicholas J. White, St. Joseph, both of Mich.

[73] Assignee: Auto Specialities Manufacturing Company, St. Joseph, Mich.

[22] Filed: Oct. 2, 1974

[21] Appl. No.: 511,442

[52] U.S. Cl. ..... 254/98

[51] Int. Cl.[2] ..... B66F 3/08

[58] Field of Search..... 254/98, 99, 100

[56] References Cited

UNITED STATES PATENTS

| | | | |
|---|---|---|---|
| 2,176,014 | 10/1939 | Ryerson | 254/100 |
| 2,731,232 | 1/1956 | Lucker | 254/98 |
| 2,784,939 | 3/1957 | Palka | 254/99 |
| 2,895,712 | 7/1959 | Stovern | 254/100 |
| 2,980,397 | 4/1961 | Lucker | 254/101 |
| 3,013,772 | 12/1961 | Atherton | 254/99 |
| 3,356,184 | 12/1967 | Bidgood | 254/7 R |

FOREIGN PATENTS OR APPLICATIONS

| | | | |
|---|---|---|---|
| 528,933 | 11/1940 | United Kingdom | 254/100 |

*Primary Examiner*—Al Lawrence Smith
*Assistant Examiner*—Robert C. Watson
*Attorney, Agent, or Firm*—Olson, Trexler, Wolters, Bushnell & Fosse

[57] ABSTRACT

The embodiment of the invention disclosed herein is directed to a lifting jack having an upstanding hollow strut member for rotatably receiving a screw rod therein. The strut member has a flat front wall which forms a glide surface and inwardly turned portions to form a rear glide surface. The inwardly turned portions are spaced apart to provide a longitudinal opening through which extends a slide member secured to a load-lifting support element. The upper end of the screw rod is provided with a non-circular configuration having flat side wall portions and shoulder portions extending therefrom to be inserted into a recess formed in a washer which is to rotate therewith. The washer bears against a pair of thrust disks which are positioned between the upper end of the strut member and the washer. The thrust disks provide multiple thrust bearing surfaces for increased wearability and ease of turning under heavy loads. The lower portion of the screw rod is flattened to prevent unthreading of the screw rod from the load-bearing member. The load-lifting support element has spaced apart sidewall portions on opposite sides of the strut member and a load-bearing front wall portion and a load-bearing rearwall portion which are spaced from the strut member by means of glide elements positioned therebetween. The glide elements substantially reduce the amount of friction existing between the load-lifting support element and the strut member.

5 Claims, 5 Drawing Figures

BUMPER SCREW JACK

BACKGROUND OF THE INVENTION

This invention relates generally to automobile lifting jacks, and more particularly to a screw jack.

Automobile lifting jacks heretofore have been generally of the single leg ratchet type having a strut member provided with ratchet teeth engaging a load-bearing movable member which is moved upwardly and downwardly upon the strut member by manipulating a ratchet mechanism. While this type of automobile lifting jack is generally sufficient, it has the distinct disadvantage of providing only incremental adjustment during the lifting of the automobile, this adjustment corresponding to the space between the teeth formed on the strut member. Furthermore, should one of the teeth fracture from the strut member there is the possibility of the entire automobile collapsing and injuring someone.

To provide a more reliable jack arrangement, a screw jack has been utilized. The screw jack incorporates a hollow strut member having a threaded shaft extending therethrough and which shaft passes through a threaded element engaging the load-bearing member of the jack to raise and lower an automobile while the threaded shaft is turned. While this type of automobile lifting jack provides continuous adjustment between its lower and upper limits they have been relatively expensive and complicated to manufacture. Also, in some instances screw jacks for automobile use have required two or three supporting legs in addition to the strut member for sufficient rigidity to prevent the automobile from falling off the jack. While single leg screw jack configurations have been developed in the past and provide substantial improvements over prior art type bumper jacks of both the ratchet and multi-leg screw types, they are relatively expensive to manufacture.

SUMMARY OF THE INVENTION

Accordingly, it is an object of this invention to provide a new and improved automobile lifting jack of the screw type which is efficient and reliable in operation and relatively inexpensive and simple to manufacture.

A feature of this invention is the utilization of flat disks as thrust bearings and an enlarged washer engaged therewith and which washer has a recess formed therein to receive a non-circular configurated upper end portion of the screw rod for rotation therewith as the handle of the jack is turned.

Another feature of this invention is the utilization of a fabricated load-lifting member having spaced apart wall portions positioned on opposite sides of a strut member and front and rear load-bearing wall surfaces spaced from the strut member by means of a glide element positioned therebetween. The glide element is a relatively small flat low-friction material such as plastic, nylon or treated metal or the like.

Another feature of this invention is the utilization of a foot structure for receiving the lower end of the strut member and maintaining the strut member at an angle relative to the vertical in the order of about seven to nine degrees so that upon placing a load on the strut member the strut member will tend to approach the vertical position.

Still another feature of this invention is the provision of means such as by flattening or otherwise deforming the bottom end of the screw rod to prevent unthreading of the rod from the jack mechanism.

Many other objects, features and advantages of this invention will be more fully realized and understood from the following detailed description when taken in conjunction with the accompanying drawings wherein like reference numerals throughout the various views of the drawings are intended to designate similar elements of components.

DETAILED DESCRIPTION OF THE ILLUSTRATED EMBODIMENT

Figures 1, 3:
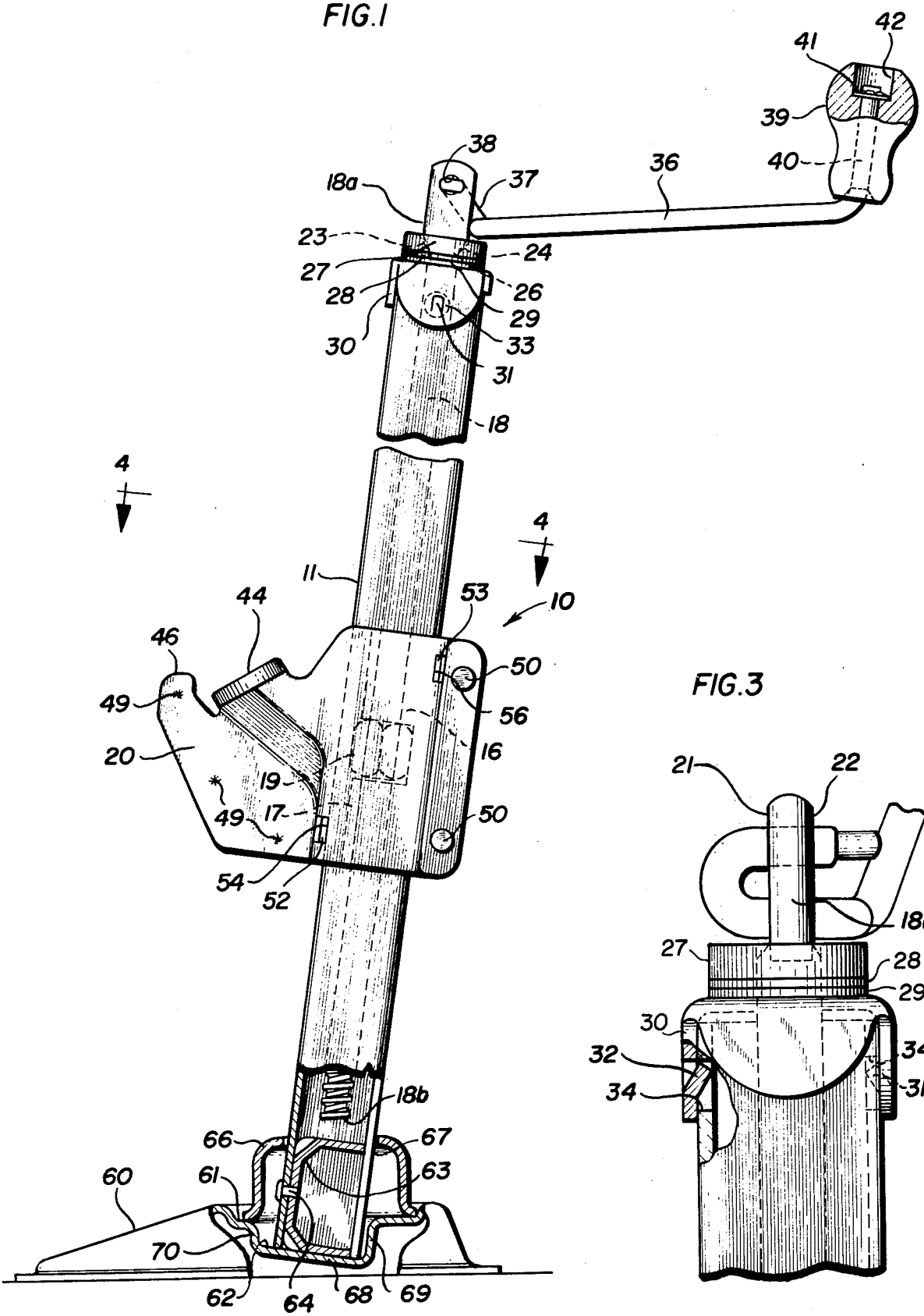
FIG. 1 is a side elevational view of an automobile screw jack constructed in accordance with the principles of this invention.
FIG. 3 is a front view of the upper end of the screw jack of this invention illustrating the formation of the cap member thereof.
Figure 2:
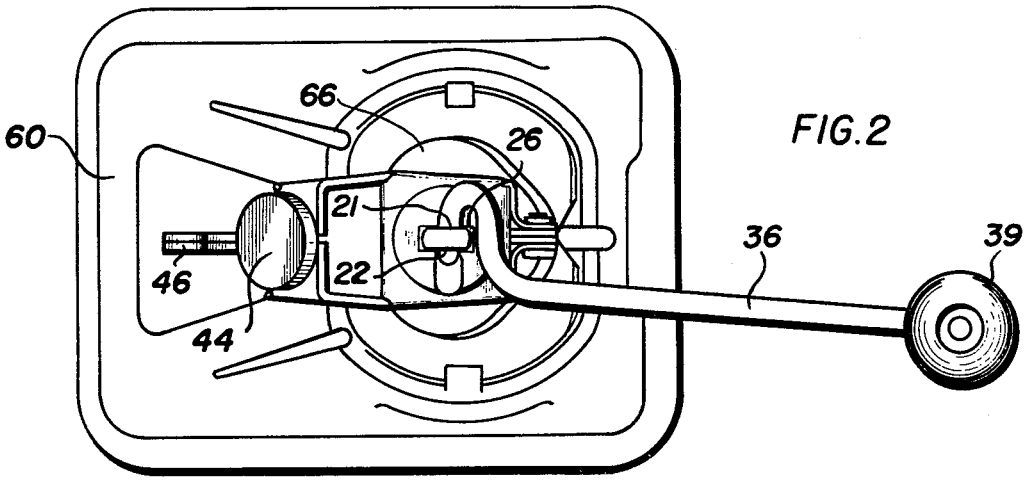
FIG. 2 is a top view of the screw jack in FIG. 1.
Figure 4:
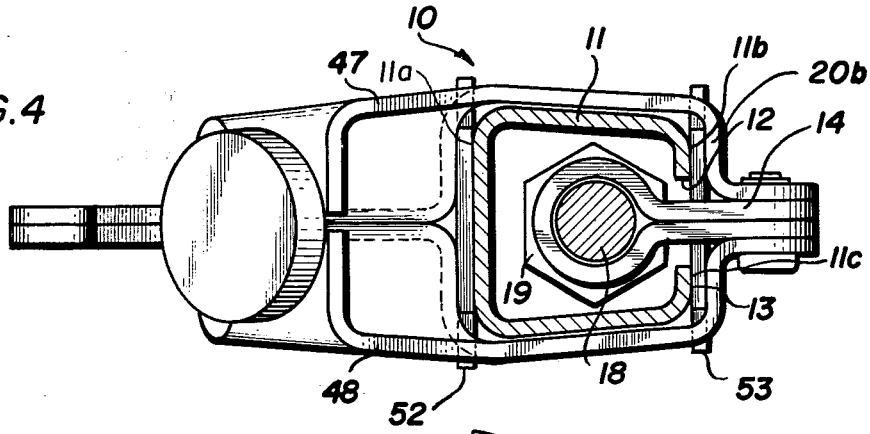
FIG. 4 is a sectional view taken along line 4—4 of FIG. 1.
Figure 5:
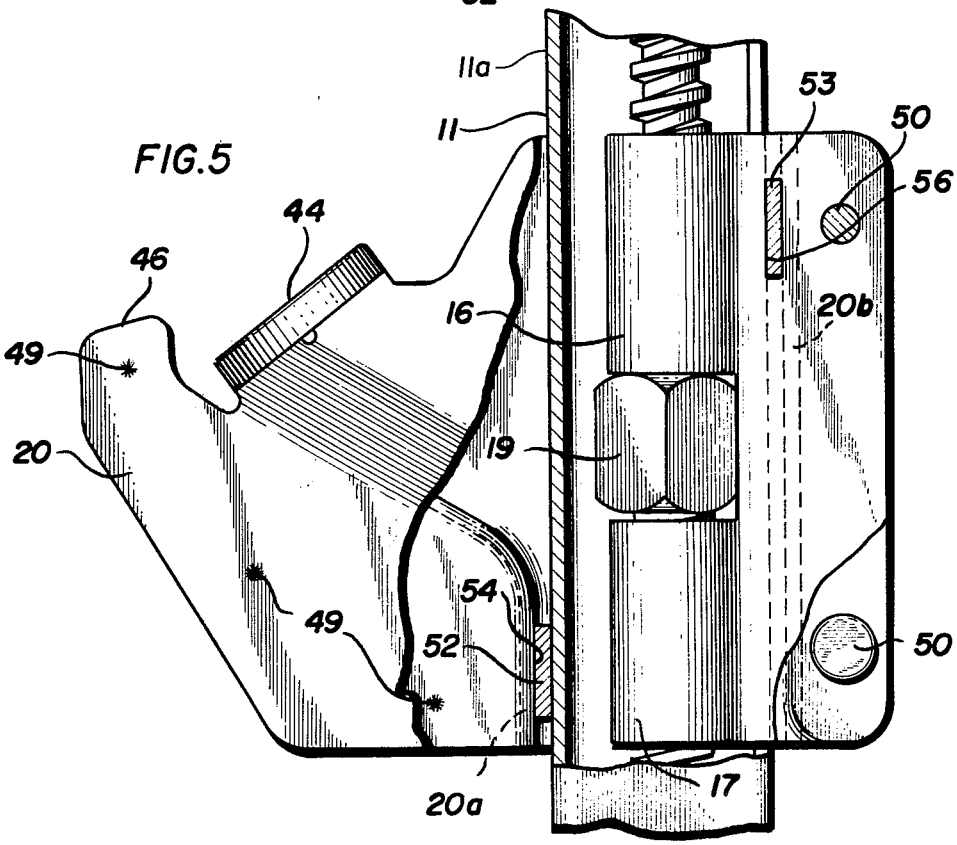
FIG. 5 is a detailed view of the load-bearing member and slide elements associated therewith for vertical linear movement along the threaded rod.

Referring now to the drawings, and particularly to FIG. 1, there is seen a screw lifting jack constructed in accordance with the principles of this invention and designated generally by reference numeral 10. The screw lifting jack 10 includes an upstanding hollow strut member 11 which may be formed of rolled steel into a somewhat C-shaped cross-section, as best seen in FIG. 4. The strut member 11 has a flat glide surface 11*a* formed along the front portion thereof. End portions 11*b* and 11*c* of the strut are turned to form a second glide surface arrangement and are maintained sufficiently spaced apart to form a longitudinal opening 12. A slide member 14 extends through the longitudinal opening 12 and has spaced apart circular portions 16 and 17 wrapped about a threaded screw rod 18 and are positioned on opposite sides of a threaded nut member 19. As the screw rod 18 is rotated the threaded nut member 19 moves upwardly or downwardly, depending on the direction of rotation of the screw rod, to carry the slide member 14 therewith. The slide member 14 is firmly secured to a load-lifting member 20 by rivets or bolts or the like. The relatively narrow opening 12 helps protect the screw rod 18 from dirt and other foreign matter.

The screw rod 18 is rotatably supported within the strut member 11 at the upper end thereof. The upper end 18*a* is non-circular in configuration, preferably having flat sidewall portions 21 and 22 and shoulder portions 23 and 24, as best seen in FIGS. 1 and 3. The shoulder portions 23 and 24 are preferably beveled and fit into a non-circular recess 26 formed in a washer element 27 and mate with similarly beveled bottom surfaces of the recess. The washer element 27 therefore rotates in unison with the screw rod and provides a load-bearing element to be urged downwardly against a pair of thrust washer elements 28 and 29. The thrust washers 28 and 29 are positioned on top of a cap member 30 which is formed to have folded down side portions engaging the sidewalls of the strut member 11. A simple and efficient means for securing the cap member 30 to the strut member 11 is obtained by providing inwardly turned portions 31 and 32 on opposite sides of the cap member. These turned portions are bent inwardly to partially engage apertures 33 and 34, respectively, formed at the top end of the strut member 11. This structural configuration substantially also reduces the cost of forming a screw jack while providing means for securely holding the screw jack assembly together.

By providing the pair of thrust washer elements 28 and 29 between the washer element 27 and the cap member 30 there is provided three mating rotatable surfaces. Therefore, the wearability of the components is substantially increased without the need of ball bearings or roller bearings. Furthermore, the coefficient of friction between the various elements may vary, due to dirt and foreign matter entering between the bearing surfaces, and when one mating surface has increased friction another mating surface will provide the relative rotation therebetween. This provides a simple and inexpensive screw jack capable of lifting heavy loads while applying only a minimum amount of pressure to the screw rod.

While the thrust bearing washers 28 and 29 are free to rotate relative to one another and relative to their engaging surfaces of the washer 27 and cap member 30, respectively, the thrust washers tend to rotate primarily relative to one another. Therefore thrust washer 28 tends to rotate with the washer 27 while thrust washer 29 tends to remain stationary with the cap 30 so that relative movement occurs primarily only at the interface between the thrust washers.

A crank handle 36 has a bent end portion 37 engaging an aperture 38 formed in the upper end portion 18*a* of the screw rod 18. This handle is provided with a knob 39 rotatably positioned upon a bent-up portion 40 and held in place by a push-nut 41 inserted through an enlarged diameter recess 42.

The load-lifting member 20 includes a pad 44 positioned immediately adjacent an upwardly directed hook portion 46 which may be fashioned to engage the lower turned-in edge of an automobile bumper. The pad 44 prevents the load-lifting member 20 from scratching or otherwise damaging the bumper or other automobile parts. The load-lifting member, as best seen in FIG. 4, includes a pair of diametrically opposed spaced apart wall sections 47 and 48 which may be secured together at the front end thereof by spot welds indicated generally by reference numeral 49, FIG. 1. The rear wall portion of the load-lifting member 20 is held together by rivets 50 and wherein the spaced apart slide members 16 and 18 are secured.

Most advantageously, the load-lifting member 20 includes a lower front glide 52 and an upper rear glide 53 which provide an inexpensive yet reliable smooth bearing surface for the load-lifting member as it traverses the length of the strut member 11. The glide members 52 and 53 may be formed of any relatively smooth structurally strong material such as nylon, Teflon, or other suitable plastics as well as metal if desired. The glides 52 and 53 are inserted into rectangular apertures 54 and 56, respectively, and provide still another means of producing a high-quality inexpensive screw jack for automobiles. The glide members 52 and 53 maintain the spaced apart wall sections 47 and 48 of the load-bearing member 20 in an aligned condition at all times as it traverses the length of the strut 11. This also maintains the slide members 16 and 17 in substantial alignment about the screw rod 18 to prevent binding. The glide members 52 and 53 are held in place between the spaced apart wall portions 47 and 48 by tabs formed at the end thereof which are inserted into slots formed in the wall members. The glides have enlarged dimension portions extending between the spaced apart wall members and are thereby captured therein to prevent them from dislodging. The glide member 52 is positioned between the front wall 11*a* of the strut 11 and a wall section 20*a* of the load-lifting member 20. Similarly, the glide member 53 is positioned between the inwardly turned rearwall forming portions 11*b* and 11*c* and a wall forming portion 20*b* of the load-lifting member 20. The tendency of the load-lifting member to pivot about its support engaging surface between the threaded member 19 and the upper circular portion 16 will cause the glide members 52 and 53 to accept substantial amounts of the load exerted on the jack. The load-bearing member 20 therefore is formed of an inexpensive stamping welded together as indicated by reference numerals 49 and arranged for movement upon the strut member 11 by sliding therealong with the glide members 52 and 53 providing a movable load-bearing surface therebetween. While the load-bearing member 20 is here illustrated as a sheet metal stamping, it will be understood that it can be formed by casting or the like. This feature also provides for a relatively inexpensive highly reliable jack structure.

Still another novel feature of this invention is the formation of a flattened or otherwise shaped end 18*b* of the screw rod 18 to deform the endmost threads formed therealong for preventing the screw rod from unthreading from the threaded nut member 19. This will then prevent inadvertent disassembly of the load-bearing member 20 from the support strut 11 and the screw rod 18.

To prevent the lifting jack 10 of this invention from pivoting forwardly, rearwardly or from side to side during the normal lifting operation of an automobile, the strut 11 bottom end portion is inserted into a foot member 60 formed from a stamping to have a first recess portion 61 leading into a second and lowermost recess portion 62. The bottom of the strut 11 is provided with a column brace member 63 and is riveted or otherwise secured in place as indicated by reference numeral 64. A crown or cap member 66 is positioned over the recess 62 and is secured to the foot 60 by welding or the like. An opening 67 is formed in the cap and is of a size to firmly hold the strut member 11 relative to the foot 60 and prevent pivotal movement therebetween. The lower recess 62 has a slanted bottom wall portion 68 which has a rear wall portion 69 formed longer than a front wall portion 70. The extended length of the rearwall portion 69 helps prevent pivotal movement beyond a predetermined limited amount. In the illustrated embodiment the vertical axes of the lower wall 68 is in the order of about seven to nine degrees from the axes passing through the strut member. By forming the first recess 61 leading into the second recess 62 within the foot member improved strength and rigidity is obtained. To insure that the proper rearward angle is maintained, the depending wall portion 69 is placed forwardly of the rear portion of the opening 67.

What has been described is a simple and efficient high-quality low-cost lifting screw jack. Accordingly, it will be understood that variations and modifications of this invention may be incorporated without departing from the spirit and scope of the novel concepts disclosed and claimed herein.

The invention claimed is as follows:

1. A lifting jack comprising: an upstanding hollow strut member having a longitudinal opening along one side, a screw rod rotatably disposed in said strut member, support means at the upper end of the strut member and screw rod for supporting the screw rod in the strut member, the support means including a cap secured to the top of the strut member and having a flat top, first and second flat disk members directly atop the cap each having flat bearing surfaces and a washer element directly atop the flat disk member, the washer element including a flat bearing surface for engaging a disk and a noncircular recess at least partly defined by bevelled bottom surfaces, the screw rod being formed with shoulder portions bevelled to fit into the washer element noncircular recess and mate with the recess bottom surfaces so as to cause the washer element to rotate in unison with the screw rod, the support means thereby providing a first planar frictional bearing interengagement plane between the directly and abuttively interengaging washer element and the first flat disk, a second planar frictional bearing interengagement plane between the directly and abuttively interengaging first flat disk and second flat disk, and a third planar frictional bearing interengagement plane between the directly and abuttively interengaging second flat disk and flat cap top, the lifting jack further including load-lifting means interconnected with the screw rod for movement longitudinally of the screw rod upon screw rod rotation, the load lifting means including spaced apart side wall members on opposite sides of and exterior to the strut member, and unitary planar glide members each fixed in the load lifting means between mounting slots in the side wall members and having enlarged portions extending between the side wall members to slidably bear against the upstanding strut member and encourage easy motion of the load lifting means up and down the strut member.

2. The lifting jack as set forth in claim 1 wherein said load-lifting means includes slide means secured to said spaced apart wall members and extending through said longitudinal opening of said strut member to engage said screw rod, said slide means including longitudinally spaced apart circular portions wrapped about said screw rod, a threaded member positioned between said spaced apart circular portions and threadedly engaging said screw rod to raise and lower said load-lifting means when said screw rod is rotated.

3. The lifting jack as set forth in claim 1 wherein said cap has bent portions struck therefrom and inserted into openings formed at the upper end of said strut member for retaining said cap in position thereon.

4. The lifting jack as set forth in claim 1 wherein the bottom portion of said screw rod is deformed to prevent unthreading of said screw rod from said load-lifting means.

5. The lifting jack as set forth in claim 1 wherein one glide member is positioned across the lower front portion of said spaced apart wall members and the other glide member is positioned across the upper rear portion of said spaced apart wall members to extend between said wall members and across the longitudinal opening of said strut member.

* * * * *